United States Patent [19]
Sobole
[11] 4,207,054
[45] Jun. 10, 1980

[54] SAFETY IGNITION VALVES

[75] Inventor: Pierre Sobole, Ruffey les Echirey, France

[73] Assignee: Societe Bourguignonne de Mecanique, France

[21] Appl. No.: 857,756

[22] Filed: Dec. 5, 1977

[30] Foreign Application Priority Data

Dec. 7, 1976 [FR] France ..... 76 36750

[51] Int. Cl.[2] ..... F23M 5/00; H01M 4/84

[52] U.S. Cl. ..... 431/69; 431/78; 137/66

[58] Field of Search ..... 431/78, 80, 69; 137/66; 251/79

[56] References Cited

U.S. PATENT DOCUMENTS

| | | | |
|---|---|---|---|
| 2,268,960 | 1/1942 | Ray | 137/66 |
| 2,290,047 | 7/1942 | Hildebrecht | 137/66 |
| 2,290,048 | 7/1942 | Hildebrecht | 431/46 |
| 2,513,257 | 6/1950 | Stroebel | 431/45 |
| 2,734,563 | 2/1956 | Newell | 137/66 |
| 2,946,376 | 7/1960 | Thornbery | 137/66 |
| 3,021,857 | 2/1962 | Davidson | 137/66 |
| 3,034,571 | 5/1962 | Matthews | 431/80 |
| 3,664,803 | 5/1972 | Cade | 431/69 |
| 3,751,212 | 8/1973 | Hron | 431/69 |
| 4,125,356 | 11/1978 | Ohashi et al. | 431/80 |
| 4,147,494 | 4/1979 | Ando et al. | 431/80 |

*Primary Examiner*—Carroll B. Dority, Jr.
*Assistant Examiner*—Randall L. Green
*Attorney, Agent, or Firm*—Robert E. Burns; Emmanuel J. Lobato; Bruce L. Adams

[57] ABSTRACT

A safety ignition valve for a pilotless burner comprises a valve body having an inlet for connection to a fuel supply, an outlet for connection to the burner and a valve seat between the inlet and outlet. A valve member is movable between a closed position in which it is seated on the valve seat and an open position in which it is spaced from the valve seat. A spring acting on the valve member biases it toward closed position. A first solenoid which is energized by current produced by a thermocouple heated by the burner acts on the valve member to hold it in open position against the bias of the spring. A second spring solenoid located in a control box fixed to the valve body actuates a plunger for moving the valve member to open position when the second solenoid is energized. Circuitry is provided for energizing an igniter associated with the burner and for energizing the second solenoid for a short period of time to move the valve member from closed to open position and to hold it in open position until the burner has been ignited and the thermocouple is heated by the burner to energize the first solenoid. Thereupon the first solenoid takes over and holds the valve member in open position. In one embodiment both solenoids are on the same side of the valve member and operate through the same plunger while in another embodiment the first solenoid is on one side of the valve member and operates on a valve stem while the other solenoid is on the opposite side of the valve member and actuates a plunger which acts on the valve member.

8 Claims, 3 Drawing Figures

SAFETY IGNITION VALVES

The invention relates to improvements to safety ignition valves for burners or radiant panels, comprising fuel-gas injectors provided with a spark-arrester supplied by an igniter.

Valves are already known intended for a burner without a pilot-light, which valves are provided with a body having a gas supply pipe, a housing for an injector; an associated seat and clack-valve normally pressed one against the other by spring means, located downstream of the supply pipe and upstream of the injector; a magnetic head comprising a small plate connected to the clack-valve by means of a rod associated with which is a thermocouple associated with the burner; a push-rod sliding axially, connected kinematically to the clack-valve and to the plunger core of a coil passing through the winding of which is a current for controlling a control member having a time-lag also supplying an igniter associated with the injector. By means of the coil, the control current is able to move the push-rod in the direction in which the clack-valve is separated from its seat and simultaneously facilitates the operation of the igniter and spark-arrester causing combustion of the gas. Subsequently, the valve is under the control of the thermocouple. These valves have drawbacks: only the electromagnetic control makes it possible to ensure opening of the clack-valve; various mechanical parts are interposed between the push-rod and the clack-valve, which make the apparatus complicated, expensive, unreliable, bulky and require external electrical connections.

U.S. Pat. No. 2,290,048 also describes an ignition valve controlled solely electrically, associated with a burner having a pilot-light comprising a thermocouple associated with the pilot-light keeping the clack-valve open, during operation. However, a valve of this type does not have a manual control and requires a permanent source of current. The electrical members are partly movable and therefore unreliable. They interfere with each other.

French Pat. No. 1,573,058 describes an ignition valve controlled solely manually, associated with a burner having a pilot-light also comprising a thermocouple. However, there is no electromagnetic control of the opening of the clack-valve.

French Pat. No. 2,005,824 describes a simple, either electromagnetic or manual ignition valve. However, this valve is bulky and comprises an external electrical source as well as moving electrical members.

German Auslegeschrifts Nos. 1,109,624, 1,104,467 and 1,254,558, French Pat. No. 1,005,308 and U.S. Pat. No. 2,513,257 propose valves which do not simultaneously comprise an electromagnetic control and a manual control, are devoid of a permanent external electrical source, are of low bulk and have a reduced number of parts.

The invention intends to obviate these drawbacks by proposing a valve more specifically applicable to radiant panels, i.e. heating means able to operate under difficult conditions, are provided with an integrated igniter, comprising an emergency manual control, is of very low bulk and comprises the smallest number of moving parts, whereof the various ignition operations are synchronized, comprising complete electrical safety.

The objects are achieved by the fact that the valve comprises a valve body provided with a supply pipe for fuel-gas, a housing for an injector, a valve seat, a clack-valve permanently biased towards its seat by a spring, a magnetic head integral with a clack-valve, associated with which is a thermocouple associated with the burner in order to keep the clack-valve open at the time of normal operation of the burner, with a push-rod driven by a control coil, sliding along the axis of movement of the clack-valve, in order to make it possible to separate the clack-valve from its seat, characterised by the fact that it also comprises, fixed directly to the valve body, a control box provided firstly with electrical input terminals able to be connected to a control member having a time-lag and on the other hand with a lug for earthing the entire device; said control box serving as a housing on the one hand for a cylindrical support in which the mechanical moving parts are located: guide ring, push-rod, plunger core, push-button forming part of the manual control means making it possible, in the absence of operation of the control coil comprising a floating core, to move the push-rod in the direction in which the clack-valve is opened and serving as a housing on the other hand for all the fixed electrical members: a printed circuit or equivalent ensuring the electrical connections from the input terminals on the one hand to a rectifier supplying the control coil and on the other hand to an igniter connected to a spark-arrester.

The valve according to the invention may be controlled manually; its structure makes it possible to reduce its bulk considerably; the electrical part devoid of moving members may be enclosed in a metal box also containing certain mechanical members fixed to the valve body and comprising effective earthing at a point as close as possible to the electrical supply sources.

Further advantages will become apparent from the description of two preferred embodiments of the invention and from the accompanying drawings in which.

Figure 1:
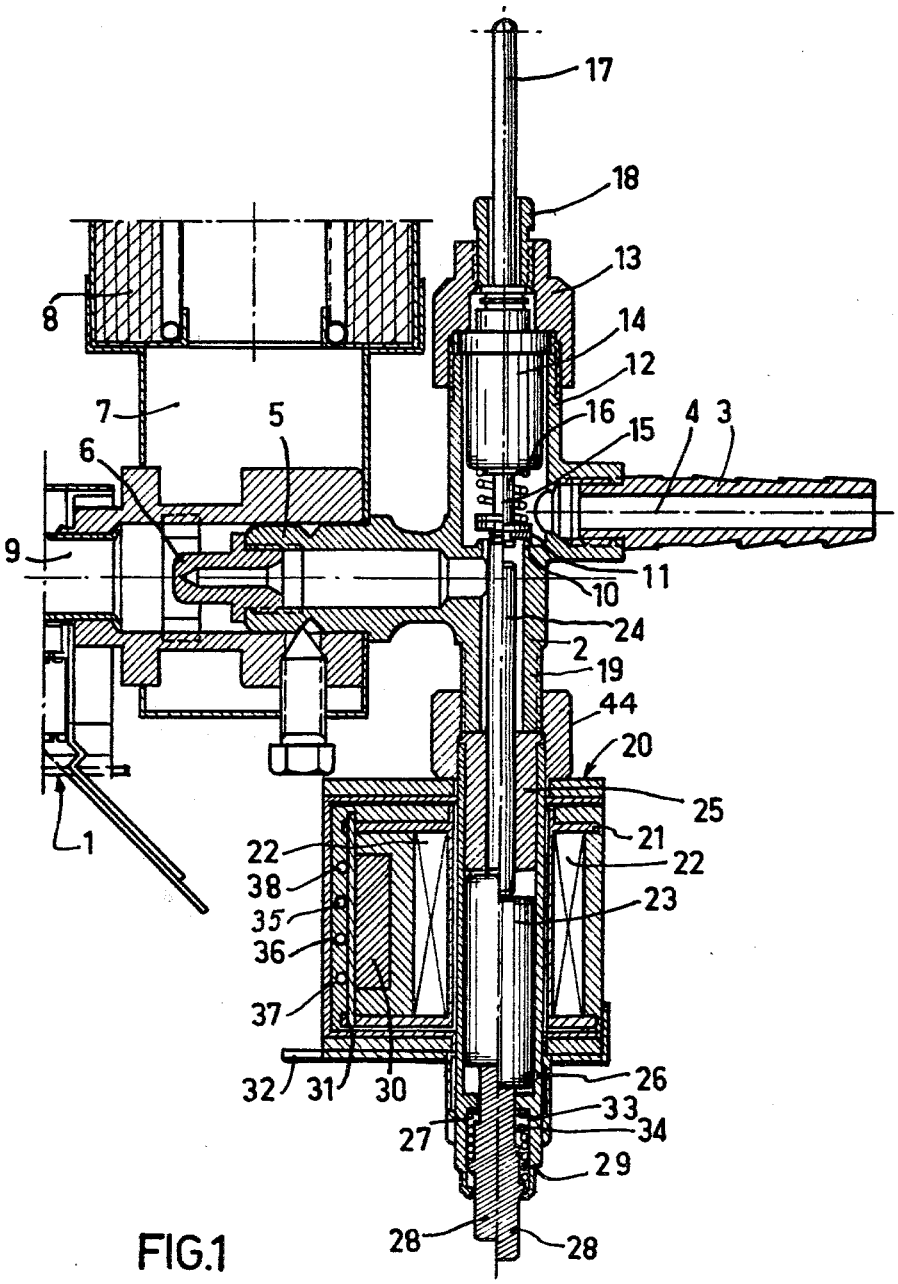
FIG. 1 is a view in elevation and axial section of the valve according to the present invention, the right-hand half view illustrating the valve in the closed position and the left-hand half view illustrating the valve in the open position.

The valve according to the invention is intended to operate in combination with at least one fuel-gas injector mounted in particular on a radiant panel 1. It comprises a heavy valve body 2 made of metal, for example brass, in contact with the burner provided with an inlet connection 3 forming a supply pipe 4 for fuel gas and with a housing 5 for an injector 6, known per se, comprising an air intake 7 possibly provided with an air filter 8. A mixer 9 located downstream of the injector 6 is associated with a radiant panel 1.

The body 2 comprises an associated seat 10 and clack-valve 11, downstream of the pipe 4 and upstream of the injector 6 to facilitate or prevent the passage of gas from the pipe 4 to the injector 6.

The body 2 comprises a hollow safety body 12 adjacent the connection 3 and housing 5, connected to the inner space for the passage of the gas in which is housed a magnetic head 14 secured by means of a gas-tight lock-nut 13 or the like, screwed onto the body 12. The magnetic head 14 comprises by way of example a fixed winding and electromagnet which are not shown and a movable plate associated with the electromagnet, which is not shown, integral with one of the two ends of a clack-valve stem 15 whereof the other opposed end is connected to the clack-valve 11, normally pressed against its seat 10 by a resilient member 16 such as a spring. The winding is connected by electrical leads 17 to a thermocouple (not shown) located in the flame of the injector or that of the burner, or at any point whose temperature is a factor in controlling the injector 6, in order that when once heated to a certain temperature, a micro-current circulating in the winding is sufficient to keep the plate pressed against the electromagnet. The leads 17 lead to a gas-tight locking sleeve 18 or the like, screwed in the nut 13 for example.

Finally, the body 2 comprises a hollow push-rod body 19, adjacent the inlet connection 3 and the housing 5, on the same axis but pointing in the opposite direction to the body 12, fixed to the end part of which, preferably in a detachable manner, in particular by screwing, is a large compact control box 20 closed-off by an outer metal casing.

This box 20 serves as a housing for a coil 21 comprising a winding 22 in which a plunger core 23 is mounted to slide axially, which core bears against a push-rod 24 mounted to slide axially in the body 19 by virtue of guide means, in particular a ring 25, and bearing at one of its two ends on the core 23 and at its other end, on the clack-valve 11, on the side opposite to that where the stem 15 is located.

When a current passes through the winding 22 of the coil 21, the plunger core 23 is moved upwards as shown in the left-hand half part of FIG. 1, thereby separating the clack-valve 11 from its seat 10, against the action of the spring 16, by means of the rod 24. On the contrary, when current no longer travels through the winding 22, the plunger core 23 and push-rod 24 are in the position shown in the right-hand half view of FIG. 1, the clack-valve 11 thus being pressed against its seat 10 by the spring 16.

The mechanical members, which are partly movable, namely the ring 25, rod 24 and core 23 are preferably enclosed in a cylindrical support 26 housed in the control box 20, open at both ends. At the end part opposite the guide ring 25, the support 26 comprises a housing 27, through which a push-button 28 passes, the inner end of which abuts against the free end part of the core 23, remote from the rod 24 and the opposite end part of which emerges from the housing 27, inside which a pushing spring 29 or the like is preferably housed, permanently biasing the button 28 towards the outside of the housing 27 in the position corresponding to the right-hand half view of FIG. 1. When the push-button 28 is pushed against the action of the spring 29, the plunger core 23 is moved in the same direction as when a current passes through the winding 22.

Also housed in the control box 20 are the solely stationary electrical means for controlling the valve, namely a current rectifier 30 and a printed circuit 31 or its equivalent ensuring the necessary electrical connections. This box is also provided with outer terminals necessary for connection to a control member having a time-lag and an earthing lug 32.

Annular gaskets 33 or the like and washers 34 or their equivalents ensure the seal of the box 20 and a nut 44 ensures its attachment and connection to the valve body 2.

The stem 15, the rod 24, the core 23 and the button 28 are arranged coaxially along the axis of the opening movement of the seat 10 and the axis of movement of the clack-valve 11, which makes it possible to achieve the most compact and concentrated arrangement of the mechanical and electrical means of the valve, the use of the minimum mechanical parts and the most direct control of the clack-valve 11.

Figure 2:
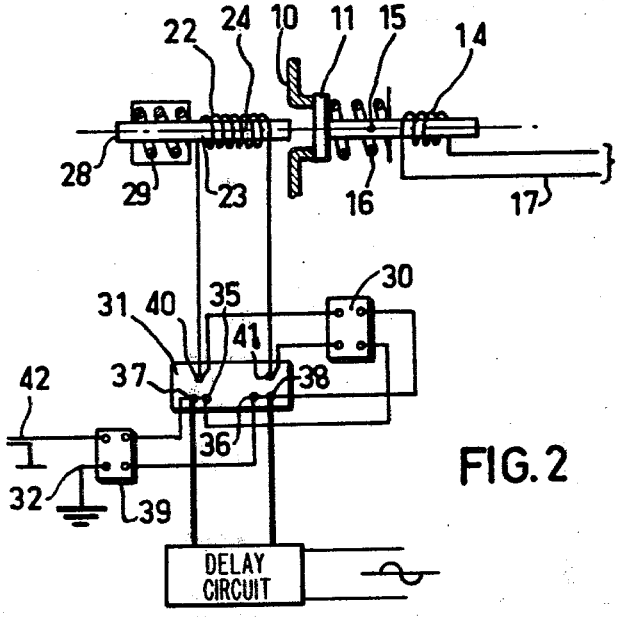
FIG. 2 is a diagrammatic view of the essential mechanical, electrical and electromagnetic parts of the valve of FIG. 1.

The electrical circuit for controlling the valve according to FIG. 2 comprises on the printed circuit 31, two terminals 37, 38 for the supply of current at 220 volts and 50 cycles from a control member having a time-lag from which are supplied, by the terminals 35, 36, on the one hand an igniter 39 which supplies high voltage discharge current, for example of 15,000 volts to a spark-electrode 42 located in an ignition area of the gas and on the other hand, the rectifier 30 supplying the coil 21 via terminals 40, 41. Earthing of the circuits of the valve and burner is advantageously achieved by the lug located in the vicinity of the burner.

The arrangement of the electrical parts as described ensures the minimum bulk. No moving parts are provided. The circuits relating to control of the opening, control of the ignition and maintaining opening are simple and independent such that a breakdown is improbable and cannot affect the other circuits. The valve does not require a permanent source of current.

The operation of the valve is as follows:

When the valve is inoperative and all its parts are in the normal stationary positions, as shown in the right-hand half view of FIG. 1, in particular the clack-valve 11 is pressed against the seat 10 by spring 16, the control member having a time-lag, in particular a manual switch or a switch governed by a thermostat, a control clock, a device for opening gates or other similar control means, sends a current of 220 volts at 50 cycles to the device, for a short period of time, which by means of the printed circuit 31 supplies the rectifier 30 and the winding 22 of the coil 21. The core 23 is moved, which causes the attendant movement of the rod 24 and thus that of the clack-valve 11 against the action of the spring 16 in the opening direction of the valve.

The 220 volt current at 50 cycles is also supplied to the igniter 39 by the printed circuit 31, which igniter sends electrical discharges for igniting the gas at the outlet of the injector 6 to the spark-electrode 42, throughout the short period of time. The gas is ignited and the injector operates.

The control member having a time-lag stops sending control current after a relatively short time, but which is adequate in order that the temperature of the thermocouple is sufficiently high in order that the latter sends to the magnetic head the current necessary for the stem 15 to be moved against the action of the spring 16 and the clack-valve 11 to be kept open.

The device is under the surveillance of the thermocouple until the time of a failure or new conditions causing stoppage of the combustion of the gas and consequently, the cooling of the thermocouple and thus stoppage of the current in the magnetic head. The stem 15 is thus moved under the action of the spring 16 and the clack-valve 11 is pressed against its seat 10.

The push-button 28 facilitates manual starting of the injector 6 in the case of non-excitation of the coil 21. The valve is thus both under electromagnetic control as well as manual control and this is without any substantial increase in the number of parts used.

Figure 3:
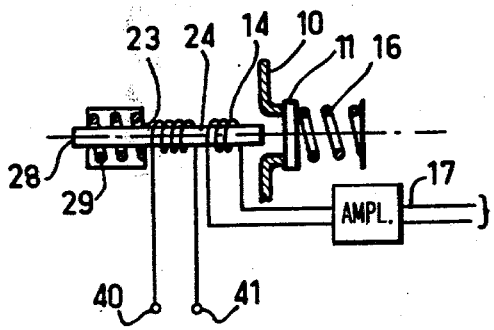
FIG. 3 is a diagrammatic view of the essential mechanical, electrical and electromagnetic parts of the valve according to a possible variation.

According to one variation of the invention and FIG. 3, the clack-valve stem 15 and the push-rod 24 are combined as a single rod actuated either by the core 23 or by an electromagnetic winding associated with the magnetic head 14, through which a current coming from the leads 17 passes, previously amplified by appropriate amplification means 45. The spring 16 is itself located either on the side of the clack-valve 11 located adjacent the single rod, or on the opposite side. A spring 16 of this type thus works by compression, or traction, when current passes through one or other of the windings of the coil 21 or magnetic head 14. This single rod may also be moved by a push-button 28.

The present invention may clearly have other embodiments which in no way affect its inventive spirit.

I claim:

1. A safety ignition valve for a pilotless burner comprising a valve body having an inlet for connection to a fuel supply, an outlet for connection to the burner and a valve seat between said inlet and outlet, a valve member movable between a closed position on said valve seat and an open position, means constantly biasing said valve member toward closed position, a first solenoid acting on said valve member to retain it in open position against the action of said bias, said first solenoid being energized by current produced by a thermocouple heated by said burner to retain said valve member in open position when said burner is burning, an igniter associated with said burner, a control box secured to said valve body, a second solenoid in said control box, a plunger actuated by said second solenoid when energized to move said valve member from closed to open position, electrical components in said control box including delay circuit means for energizing said igniter and said second solenoid for only a short period of time to move said valve member from closed to open position and to continue energizing said igniter and to hold said valve member in open position until said first solenoid is either energized by said thermocouple heated by said burner, whereupon said second solenoid and said igniter are deenergized, or to deenergize said second solenoid and igniter upon expiration of said short period of time in the event said burner fails to ignite, and a manually operable push button extending outside said control box and acting on said valve member through said plunger to move said valve member from closed to open position.

2. A safety ignition valve according to claim 1, in which said electrical components in said control box include a rectifier for supplying direct current to said second solenoid, and printed circuit.

3. A safety ignition valve according to claim 1, in which said valve member has a stem which extends in one direction from said valve member and on which said first solenoid works and in which said plunger which is actuated by said second solenoid is on the opposite side of said valve member and in alignment with said stem.

4. A safety ignition valve according to claim 1, in which said first solenoid and said second solenoid both actuate one and the same plunger for moving said valve member to, and retaining it in, open position.

5. A safety ignition valve according to claim 4, further comprising an amplifier between the thermocouple and said first solenoid.

6. A safety ignition valve according to claim 4, in which said means for biasing said valve member toward closed position comprises a compression coil spring on the opposite side of said valve member from said plunger.

7. A safety ignition valve according to claim 6, comprising a second spring acting on said plunger to bias it in a direction away from said valve member.

8. A safety ignition valve according to claim 1, in which said burner comprises a housing integral with said valve body and having a passageway in communication with said outlet, and an injector fixed in an end of said passageway.

* * * * *